United States Patent [19]

Zoudlik

[11] 4,328,987

[45] May 11, 1982

[54] ROPE-ACTUATED IMPLEMENTS

[76] Inventor: Adolph F. Zoudlik, 16832 Harpers Ferry Ave., Baton Rouge, La. 70816

[21] Appl. No.: 72,178

[22] Filed: Sep. 11, 1979

Related U.S. Application Data

[63] Continuation-in-part of Ser. No. 943,851, Sep. 19, 1978, abandoned.

[51] Int. Cl.[3] ..... B66C 3/06

[52] U.S. Cl. ..... 294/111; 37/184; 37/187; 294/70

[58] Field of Search ..... 294/70, 107–109, 294/111, 112; 37/182–188; 254/188, 189

[56] References Cited

U.S. PATENT DOCUMENTS

| | | | |
|---|---|---|---|
| 245,073 | 8/1881 | Johnson | 37/182 |
| 515,117 | 2/1894 | Curtis et al. | 37/184 |
| 1,142,485 | 6/1915 | Brown | 254/188 |
| 1,441,023 | 1/1923 | Poland et al. | 37/184 |
| 1,968,983 | 8/1934 | Barnard | 37/188 |
| 2,027,409 | 1/1936 | Weeks et al. | 37/184 |
| 2,362,268 | 11/1944 | Hall | 294/112 X |
| 2,618,506 | 11/1952 | Ehrhardt | 294/112 |
| 3,102,752 | 9/1963 | Jenkins | 294/111 |
| 3,582,127 | 6/1971 | Johnson | 294/112 |
| 3,934,917 | 1/1976 | Paxton et al. | 294/70 |

FOREIGN PATENT DOCUMENTS

| | | | |
|---|---|---|---|
| 503760 | 7/1930 | Fed. Rep. of Germany | 294/111 |
| 576566 | 4/1933 | Fed. Rep. of Germany | 294/112 |

*Primary Examiner*—Johnny D. Cherry

*Attorney, Agent, or Firm*—Arnold, White & Durkee

[57] ABSTRACT

A rope-actuated load lifting and carrying assembly is characterized by the provision of at least one first rope guide disposed so that its axis of rotation is disposed at all times below a reference plane defined perpendicularly to the joinder plane between the gripping elements and containing the axis of rotation of the center pin. The assembly is also characterized by a head arrangement wherein at least three first rope guides are disposed in a semicircular arrangement below the reference plane, the guides being angularly separated by a predetermined amount. A head assembly includes at least three second rope guides disposed in a semicircle at or above the plane containing the connection of the head with the corner arms, the second rope guides being angularly separated by a predetermined amount.

31 Claims, 14 Drawing Figures

ROPE-ACTUATED IMPLEMENTS

CROSS-REFERENCE TO RELATED APPLICATION

This application is a continuation-in-part of application Ser. No. 943,851, filed Sept. 19, 1978, now abandoned.

FIELD OF THE INVENTION

My invention relates generally to wire-rope implements for lifting and transporting bulky materials, such as clam-shell buckets, grapples and hook blocks, and to the structures in those implements upon which the ropes are reeved.

BACKGROUND OF THE INVENTION

Before I devised my invention, rope implements used to handle bulk commodities, ranging from coal and iron ore to scrap metal and to processed foodstuffs like soybean meal, have suffered from inefficiencies caused by a high ratio of implement weight to load weight. For example, present clamshell buckets used to unload ore-carrying ships can pick up at the most only 1 to 1½ pounds of ore per pound of bucket weight. Since the unloading capacity of an ore terminal is limited by the number of times per day that a bucket can be lowered into the hold of a ship and raised from it, terminal operators may achieve substantial savings, which can be passed on to the shippers and ultimately to the consumers of the product unloaded, by increasing the weight of material unloaded with each deployment of the bucket.

With this in mind, I set to inventing improvements in bucket design, which are equally applicable to grapples, hook blocks and all other implements using rope-and-pulley arrangements to lift loads. The economic incentive is considerable. At the wage, equipment charge and demurrage rates prevailing in August 1978, the cost of buckets, conveying equipment, stevedoring and demurrage average about $40,000 per day at the ore terminals in Burnside and New Orleans, La. Thus, a 50 percent increase in production will save approximately $13,000 per day.

Typical prior art buckets are depicted in U.S. Pat. Nos. 197,384, to Lord, 515,117, to Curtis et al., and 1,956,079 to Neffendorf et al. The Lord and Curtis buckets, which typify the clamshell buckets commercially available in the United States for the past 80 years or more, each have ropes or chains reeved about a large sheave which is concentrically located about the center shaft from which the bucket halves or scoops are hinged. This large sheave, which usually is a solid casting and may itself weigh a ton or more in larger buckets, contributes a high proportion of the total weight of the bucket. The Curtis bucket possesses the additional weight disadvantage of employing a large unitary sheave on the head assembly of the bucket. The Neffendorf bucket uses additional sheaves, called axles, which are affixed to the bucket hinges. The wire rope is reeved around these axles to provide greater closing force. In practical application, however, the added weight of these auxiliary axles in conjunction with the existing weight of the large head sheave, not withstanding the lack of a unitary center pivot assembly as described below, fails to improve the bucket to load weight ratio over the more conventional Lord and Curtis buckets.

Many of these prior art buckets mount the large central sheave between stubbed shaft ends, which are welded or otherwise connected to the sheave.

The bucket industry in the United States has innovated little since the advent of the basic Lord and Curtis designs. In the United Kingdom, however, bucket manufacturers have long been interested in improving bucket efficiency. In the 1949 *Proceedings of the Institution of Mechanical Engineers,* at pages 154 through 172, G. T. Shoosmith discusses the efforts of William Cory and Son, Ltd., in modernizing a coal yard. He emphasizes the understanding in this art, which prevails today, that a large sheave to rope diameter ratio is necessary to provide maximum bucket weight capacity during high-speed operation. The buckets depicted in the article put this understanding into practice by using large unitary sheaves both in the bucket head and center pivot assemblies. H. N. Wilkingson, of the British Iron and Steel Research Association, summarized the results of ten years of bucket design research in an article appearing at pages 831 through 846 of the 1963–64 *Proceedings of the Institution of Mechanical Engineers.* He dismissed lever-arm clamshell buckets as lacking interest and concluded that "wide-span" buckets were superior to clamshell buckets in efficiency, weight for weight. His article does not, however, address the technique of improving the lift ratio of buckets by reducing bucket weight. Mr. Wilkinson noted that efficiency could be improved by increasing the reeving, but doubted "whether in practice space could be found for the additional sheaves" (p. 839). Additional reeving also increases bucket cycle time, which is disadvantageous. His tests showed (p. 840) that the "sheaves should be as far from the pivot point as practicable, thereby increasing the closing torque, but not so far that grab [bucket] capacity is reduced owing to their taking up space in the shells." The wide sheaves referred to by Mr. Wilkinson correspond exactly to the "axles" of the Neffendorf bucket.

SUMMARY OF THE INVENTION

I have, therefore, devised a rope-actuated load lifting and carrying assembly, for use with wire-rope implements such as clamshell buckets and grapples in particular. From the description in this application, it will be apparent to persons skilled in this art that my invention has use in other types of rope-actuated assemblies. As used in this application, the term "rope" refers not only to hemp or sisal ropes, but also to wire ropes, belts and chains.

The assembly in accordance with my invention comprises a head assembly, at least two gripping members, which may be grapple tines or clamshell scoop halves, a corner arm pivotally connecting each gripping member to the head assembly, a center pin assembly and at least one suitably reeved rope. The center pin assembly comprises at least one, and preferably three or more, first rope guide. The head assembly comprises at least one, and preferably three or more, second rope guide located above the horizontal plane passing through the points of connection of the corner arms to the head assembly.

Another assembly in accordance with my invention comprises a head assembly, at least two gripping members adapted to engage bulk material, a corner arm connecting the outer side of each of the gripping members to the head assembly, a center pivot assembly, a hinge connecting the inner side of each gripping member to said center pivot assembly and at least one suitably reeved rope. More specifically, the gripping members may be clamshell bucket scoop halves or grapple tines. In the clamshell bucket embodiment, each scoop half will be connected to the head assembly by at least one hinge on each end of the scoop half.

The center pivot assembly in accordance with my invention may comprise an integral central load bearing shaft to which the hinges are connected, a cylindrical collar which is disposed about the central load bearing shaft and at least three support members which are radially arrayed about the collar and central load bearing shaft. The support members are attached to the collar so that each support member axis lies in a plane below a horizontal plane which passes through the rotational axis of the central load bearing shaft. To the distal end of each support member is fixed a first rope guide in a manner that will permit the rope guide to rotate. The rope guides when installed lie on half the circumference of a circle centered upon the axis of the central load bearing shaft. These first rope guides are angularly spaced apart by angle $\alpha$, where $\alpha$ equals 180° divided by the number of the first rope guides minus one. The head assembly comprises at least three second rope guides which also occupy half the circumference of a circle and which are angularly arrayed apart by an angle $\beta$, where $\beta$ equals 180° divided by the number of the second rope guides minus one. The circle diameter chosen for the head assembly need not be the same as the circle diameter chosen for the center pivot assembly. These second rope guides are arranged so that at least one of the second rope guides lies above a horizontal plane passing through the points of attachment of the corner arms to the head assembly. The result of the arrangement of the first and second rope guides in accordance with my invention is that the center pin assembly has substantially no dimension above the upper periphery of the cylindrical collar, and the head assembly has substantially no dimension below the points of attachment of the corner arms. The result of this arrangement is the provision of a load lifting and carrying assembly, especially in a clamshell bucket or a grapple, which when closed has virtually no head room between the center pin assembly and the head assembly, in contrast to the buckets and grapples of the prior art.

In order to hold the load lifting and carrying assembly in accordance with my invention and to exert a closing force upon the gripping members, at least one rope is suitably reeved through the first and second rope guides. Reeving patterns are well-known in this art. It is also possible, in accordance with my invention, to provide each clamshell bucket instructed in accordance with my invention with two center pin assemblies, with one arrangement of rope guides as described herein.

The first and second rope guides may be either cylindrical sheaves, or pulleys, or cylindrical rollers having annular grooves to receive the rope. Where chains are used, sprockets engaging the chain links may replace these sheaves or rollers. Because there is no substantial difference in rope wear between uses in which the rope is bent more than 20° and those uses in which the rope bends 180° around one sheave as in the prior art, I have found that ten sheaves or grooved rollers, each spaced 20° apart, may be employed in the center pivot and head assemblies. Of course, even more sheaves may be used depending on the characteristics of the rope.

Because of the wide use of the rope guide configurations in the center pivot and head assemblies of my invention, I consider the center pivot assembly and the head assembly each to embody the basic concept of my invention.

My invention may also be used in the so-called 4-line configuration, which has a first rope reeved through the first and second rope guides to provide a closing force upon the gripping members and further has at least one third rope guide on the head assembly through which is reeved a second rope to hold the load lifting and carrying assembly and to lift and lower it. The components of this third rope guide may be one or more cylindrical sheaves or cylindrical grooved rollers, as with the first and second rope guides. The third rope guide may also be provided by a groove on one of the rollers that acts as a part of the second rope guide. I have found that best results with wire rope are achieved where the cylindrical grooved rollers are composed of a substance that has a Rockwell C hardness of at least 60.

Although the detailed description below discloses only one hinge pair on each end of the center pivot assembly or central shaft, the use of multiple hinges connected to the central pivot assembly or central shaft is within the scope of my invention as claimed herein.

A cardinal feature of my invention is the reduction in weight of the assembly afforded by the use of multiple small sheaves or rollers in place of the massive single central sheaves as shown in the prior art. For example, if a central sheave of thirty inch radius on the center pin assembly is replaced by three sheaves having twelve inch diameter (assuming that the twelve inch diameter sheaves have the same thickness as the thirty inch radius large sheave, which of course is not necessary), the volume of the three small sheaves taken together, and thus the weight of those sheaves, will be approximately one-ninth the weight of the single large central sheave. Some of this weight advantage will be taken up by the weight of the cylindrical collar and the support arms, but these structures may be made of high strength light alloys which will not contribute appreciably to the weight of the device. This is particularly true in the commercial environment in which buckets and grapples in accordance with my invention will be used. Heretofore, buckets and grapples have been extremely heavy and have been expected to have long service lives, many on the order of years before they must be scrapped. I contemplate using the savings in weight accomplished by my invention to enable manufacturers to build much larger buckets of the same weight, which because of the lighter gauge steel to be used in them, will have shorter service lives before scrapping. Because of the savings in loading and unloading costs which my invention will provide, as detailed above, it will be economically feasible for terminal operators to buy and have installed new buckets at a more frequent rate than previously experienced, eliminating as well machine down time while waiting for the rework of conventional buckets, since replacement buckets may be kept on hand.

Another cardinal feature of my invention is the reduction or substantial elimination of head room between the head and center pivot assemblies. Specific advantages are mentioned below. No bucket or grapple in the prior art displays the feature of my invention which permits the virtual elimination of head room, namely, the construction of a head assembly with substantially no dimension below the plane of the points of attachment of the corner arms to the head assembly and of a center pivot assembly with substantially no dimension above a horizontal plane passing through the pivot axis. Buckets and grapples with this feature will when closed have the pivot axis of the center pivot assembly virtually juxtaposed to the bottom of the head assembly, quite unlike prior art buckets and grapples.

Another feature of my invention is the provision of buckets having a larger deck area per unit weight. This feature means that the hold of a vessel, for example, may be emptied and cleaned out with fewer bucket passes. Thus, not only would the terminal operators be able to remove more of the bulk product per bucket pass, but the time for unloading would be further decreased by the ease of clean up afforded by the bucket with the larger deck area.

Another feature of my invention is the ease of fabrication afforded by the reduced weight and simplicity of construction of the center pin and head asemblies in accordance with my invention. The smaller sheaves are easier to handle and may be produced in quantity on lighter equipment, thus reducing manufacturing and material costs. Manufacturers will be able to fabricate center pivot and head assemblies more readily than heretofore, with a decreased investment in manufacturing equipment necessary to produce these assemblies. Furthermore, the light grapple tines and clamshell scoop halves which may be used in connection with my invention will be cheaper and easier to manufacture.

Another feature of my invention is that no new technology will be required to fabricate load lifting and carrying assemblies in accordance with my invention. For instance, the technology required to design and fabricate bearings for the cylindrical grooved rollers I contemplate that are substantially free from fouling when they come in contact with the load, as will occur when opened buckets are lowered into the material and the center pivot assembly comes in contact with it, is presently available from manufacturers of caterpillar treads, which use sealed bearings particularly suitable for use in assemblies constructed in accordance with my invention.

Yet another feature of my invention is the use of the same size sheaves for a given range of different bucket sizes, thus eliminating the need to tailor-make sheaves for each bucket size individually. Furthermore, worn or broken sheaves and rollers may be replaced individually without disassembling the bucket or grapple, as is now required in some designs (like Curtis, for example).

Buckets and grapples in accordance with my invention have the additional feature of being able to be fabricated with shorter corner arms than buckets and grapples of the prior art, because of the substantial elimination of head room between the center pivot and head assemblies when the bucket is closed.

Still another feature of my invention arises when assemblies as described herein are used for loading, unloading and carrying operations inside buildings. The substantially reduced head room between the center pin and head assemblies permits the use of buckets in buildings with lower ceilings than permitted by prior art buckets, because the bucket, grapple or other assembly need not be lowered at so far from the overhead trolley in order to open it fully.

Yet another feature provided by some embodiments of my invention is the added strength afforded by the use of a continuous central shaft in place of the stubbed shafts often used in the prior art.

The reduced bucket weight further means that the leverage or closing force available as a proportion of bucket weight is dramatically increased over the prior art.

These features and other features and advantages of my invention will be apparent to persons skilled in this art from reading the specification and the claims appended hereto.

DETAILED DESCRIPTION OF THE PREFERRED EMBODIMENTS

Figure 1:
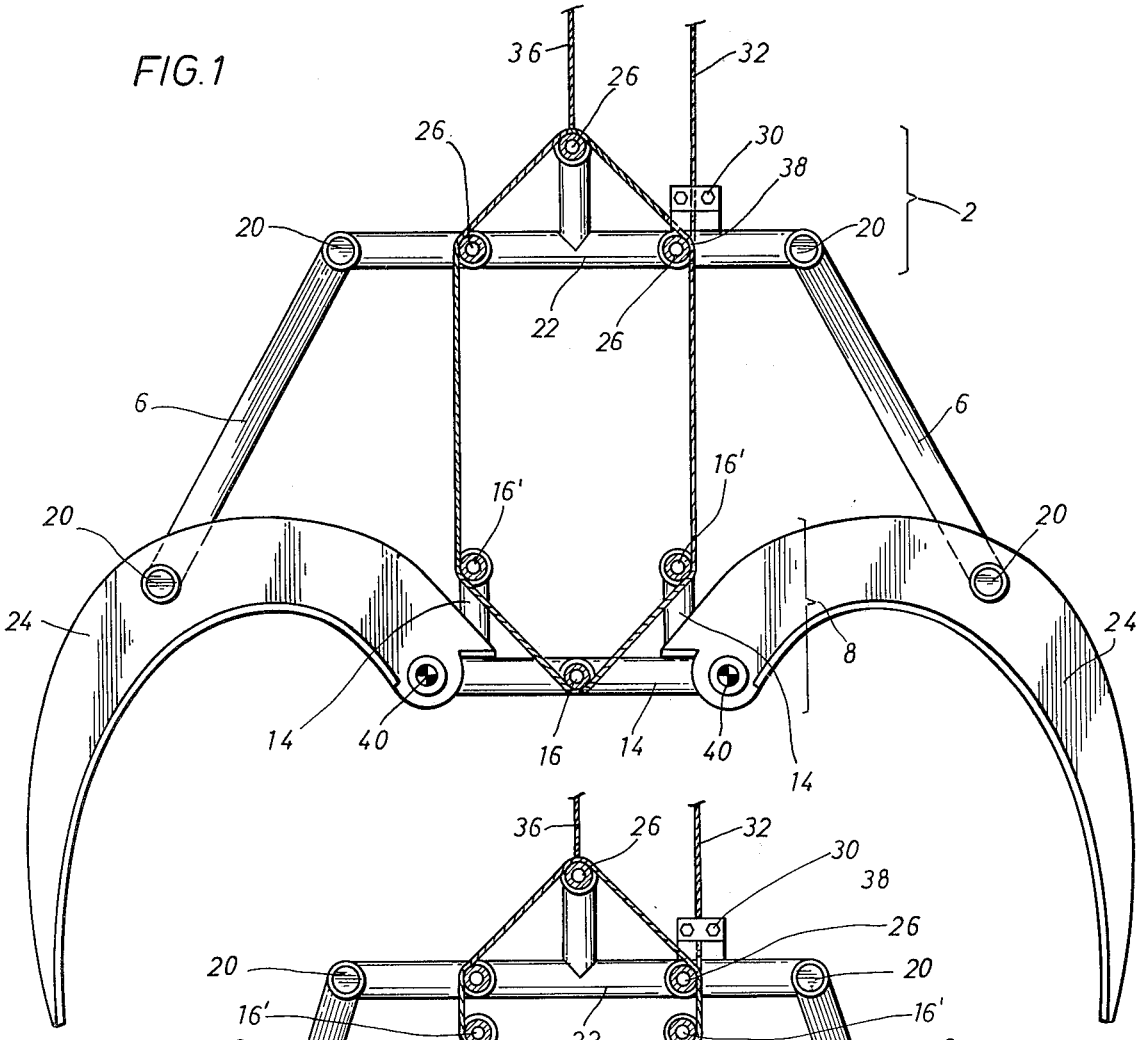
FIG. 1 is a side view of a 2-line grapple in accordance with an embodiment of my invention, depicted in the fully open position.

FIG. 1 is a side view of a 2-line grapple, two tines 24 of which are depicted in the open position. Grapples are used almost exclusively in the 2-line embodiment, although some 4-line grapples have been made in the past, and possess design features that are somewhat different from clamshell buckets. In particular, while grapples may employ a center shaft and cylindrical collar in center pin assembly 8, as disclosed herein for the clamshell buckets in FIGS. 2, 2A, 3, 3A, 4 and 4A, this construction is unnecessary for a working grapple or clamshell bucket.

Figure 1A:
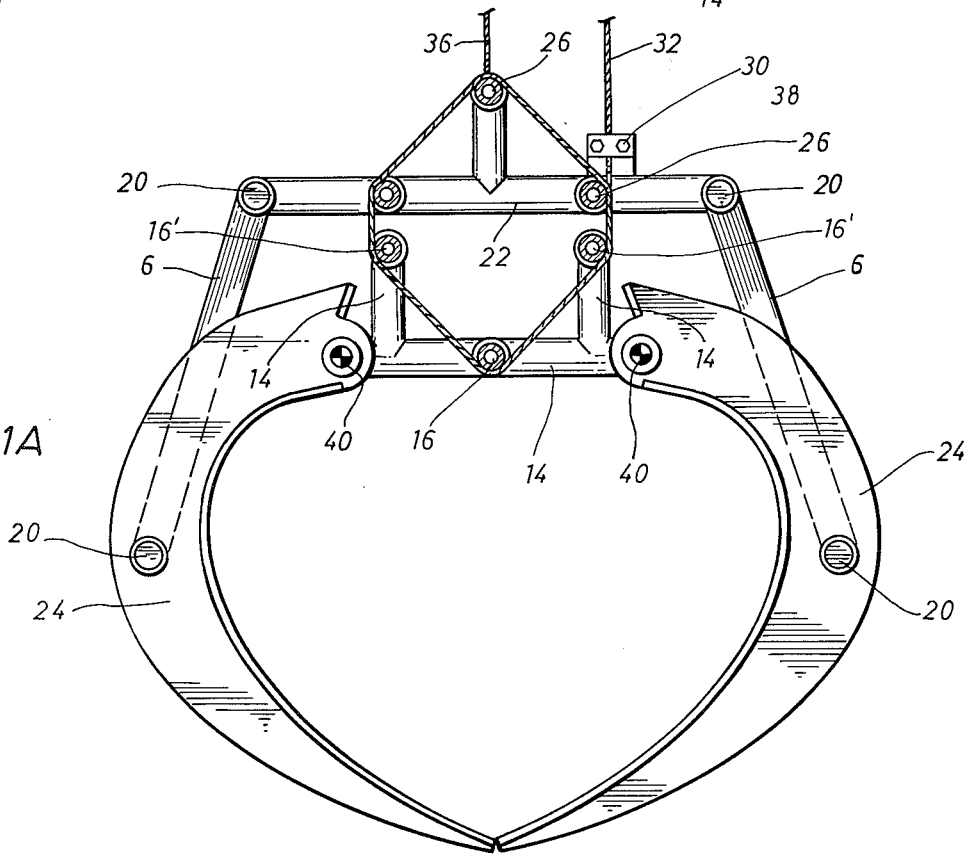
FIG. 1A depicts the grapple of FIG. 1 in the closed position.

FIG. 1A is a view of the grapple of FIG. 1 in the closed position. Since FIG. 1A possesses the same structural features as FIG. 1, I will not discuss it separately other than to say that FIG. 1A discloses what is believed to be the minimum structure that a grapple requires to operate. By this it is meant that the structure of FIG. 1A (even if more than two tines 24 were used) exhibits the minimum length of corner arms 6 necessary to perform the function of the grapple.

In FIG. 1, the grapple has tines 24, which are shaped to suit the desired use and may have teeth or other specially hardened edges for engaging the material. The corner arms 6 are attached to the head assembly 2 and the grapple tines 24 by freely swinging pivots 20. The support members 14 on center pin assembly 8 provide a bridge between the grapple tine pivot points 40, as well as form a platform on which the first rope guides 16 and 16' are mounted so that they may rotate freely. The upper first rope guides 16' are located a distance above the lower first rope guides 16 which will cause the closing rope 32 to make the maximum bend permissible for symmetrical reeving, 45 degrees in the embodiment depicted in FIGS. 1 and 1A. As in the 2-line clamshell bucket embodiments of FIGS. 4 and 4A, the closing line on the grapple of FIG. 1 deadends on second rope guide 26 at point 38 and passes through guide rollers 30 affixed to head support 22.

The closing line may also dead end on others of the second rope guides 26, depending on design requirements, but I have chosen to depict only what is shown in FIGS. 1 and 1A. Head support members 22 provide a bridge between the grapple tine pivot points 40, with the second rope guides 26 being located above the plane passing through the central axes of the pivot points 40. The closing rope 32 is reeved about both the first rope guides 16 and 16' and the second rope guides 26 and exits from the head assembly 2 to a trolley or crane boom head (not depicted) through which power may be applied to provide closing force to the grapple. The grapple is raised and lowered by holding rope 36. As in the clamshell buckets described below, all rope guides may be sprockets for chains, cylindrical sheaves or grooved rollers.

Figure 2:
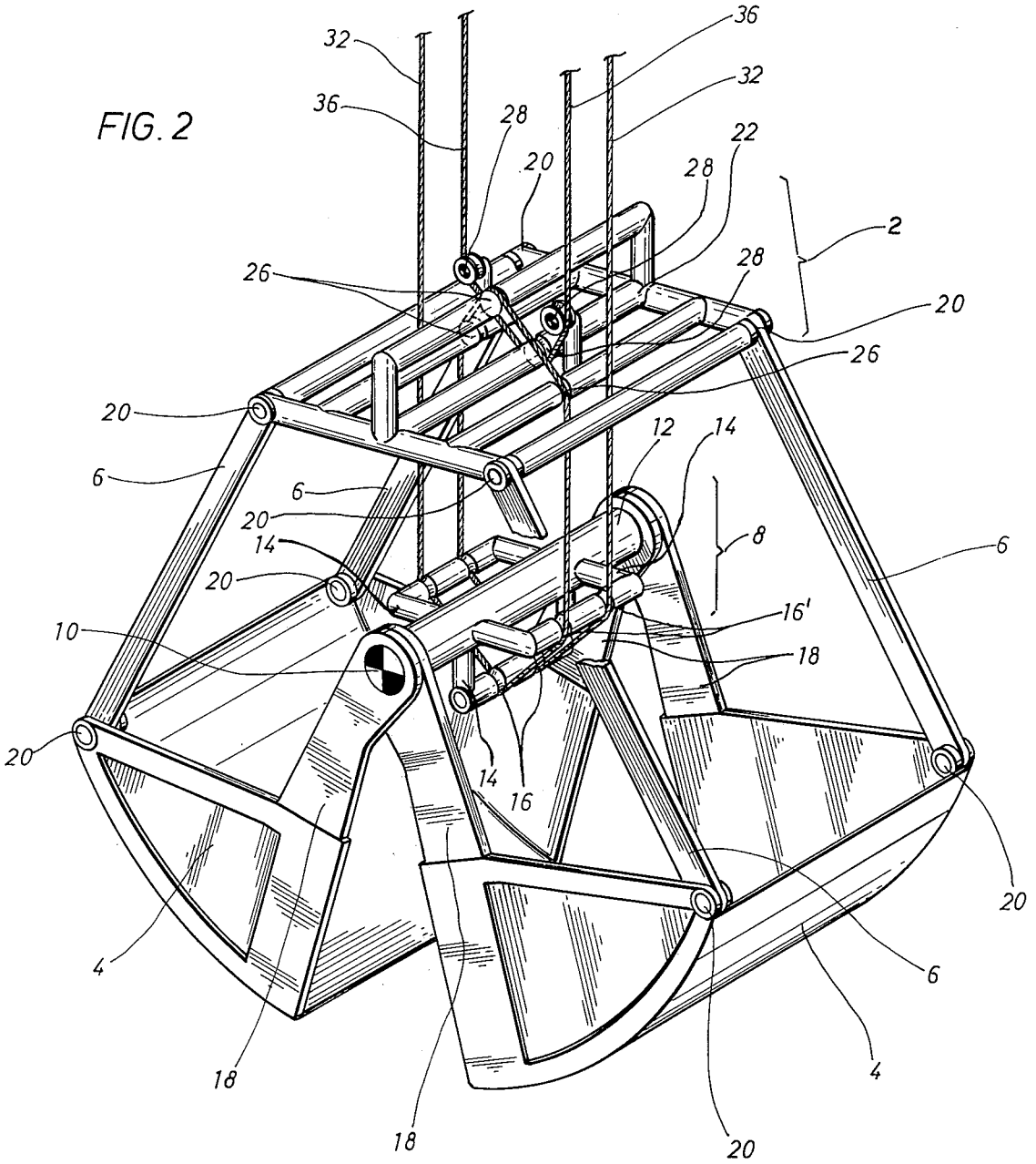
FIG. 2 is a perspective view of 4-line clamshell bucket in accordance with my invention.

FIG. 2 is a perspective view of a 4-line clamshell bucket in accordance with my invention. As shown, the head assembly is identified by reference numeral 2 and the center pivot assembly by reference numeral 8. The bucket has two clamshell scoop halves 4, which may be of a shape suitable for the desired use and which may along their inner lips have teeth or other specially hardened edges for engaging the material. The corner arms 6 are attached to the clamshell scoop halves 4 and the head assembly 2 by pivots 20 at the corners of the clamshell scoop halves 4 and the head assembly 2. The pivots 20 provide a freely swinging hinging action. The clamshell scoop halves 4 are connected with the center-pivot assembly 8 by hinges 18, which are affixed to the end of the central load bearing shaft 10, which is depicted on FIG. 2 in end view. Freely sliding about load bearing shaft 10 is a cylindrical collar 12, to which are welded the support members 14 for the first rope guides 16 and 16'. These rope guides, as explained above, may either be cylindrical sheaves or cylindrical grooved rollers 34 (as depicted on FIG. 6). FIG. 2 depicts a suitable head support structure 22, upon which the second rope guides 26 are mounted. These second rope guides 26 may either be in the form of sheaves or cylindrical grooved rollers. FIG. 2, as well as FIGS. 3, 3A, 4, 4A and 5 depict embodiments of my invention using cylindrical sheaves. The closing rope 32 is depicted on FIG. 2 as being reeved about both the first rope guides 16 and 16' and the second rope guides 26, leaving two ends of the closing rope 32 extending upward into a trolley or crane boom head (not depicted) through which power is applied to the closing ropes. The holding rope 36 is shown as reeved about the third rope guides 28 mounted on the head assembly 2. The holding ropes 36 likewise extend upward to the trolley or crane boom head, through which power may be applied to raise or lower the bucket of FIG. 2.

Figure 3:
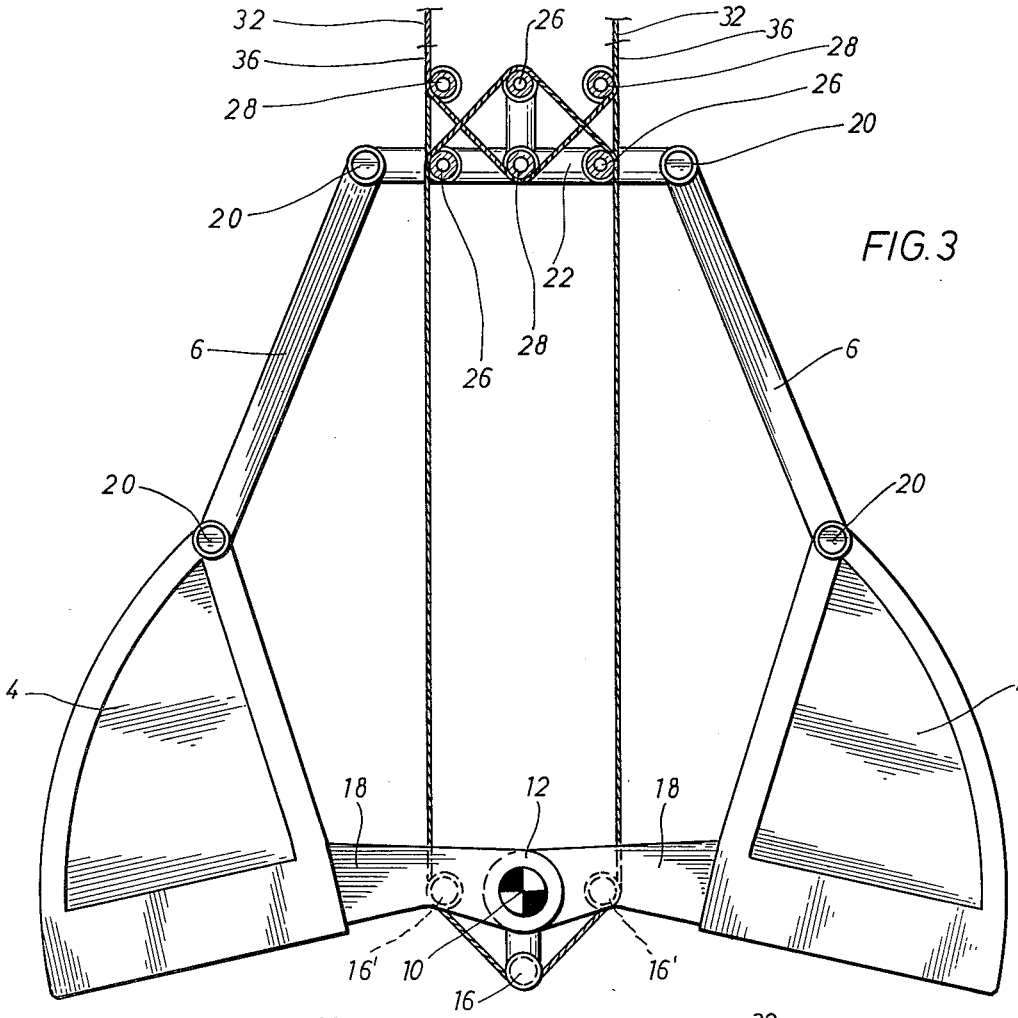
FIG. 3 is a side view of the 4-line bucket depicted in FIG. 2 in the fully open position.
Figure 3A:
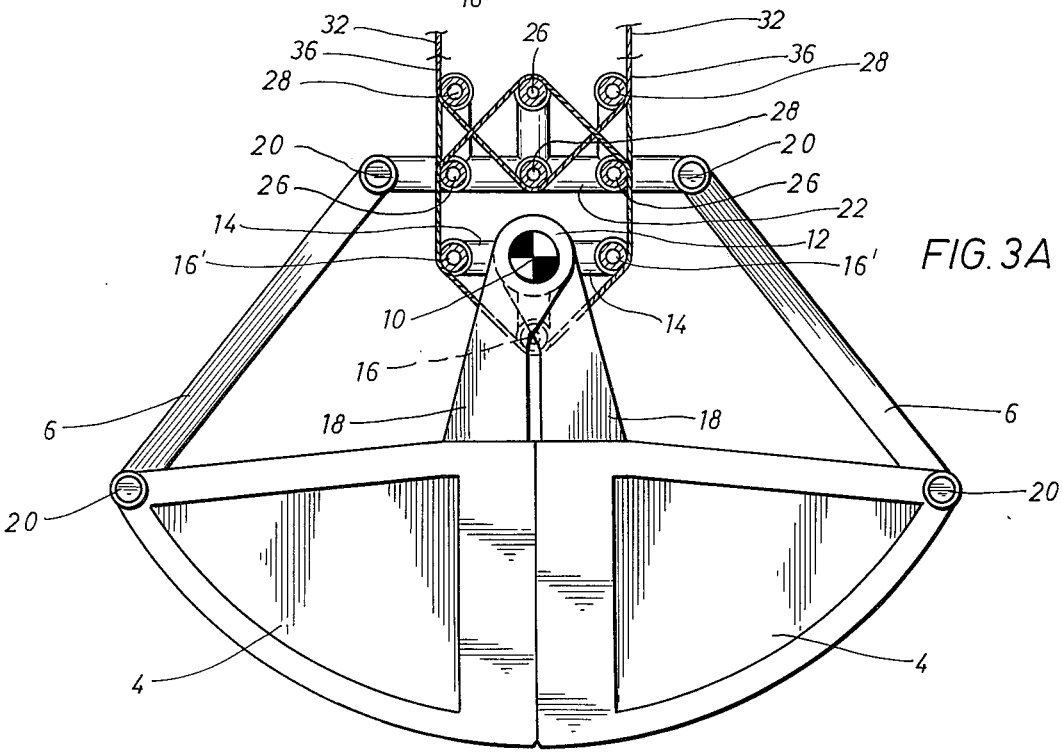
FIG. 3A depicts the bucket of FIG. 3 in closed position.

FIG. 3 shows the construction of the head and center pin assemblies in greater detail than FIG. 2. FIG. 3A shows the bucket of FIG. 3 (and FIG. 2 as well) in the closed position. It should be noted from FIG. 3A that the bucket may be closed so as to allow virtually no head room between the bottom third rope guide 28 and the top of the cylindrical collar 12. The amount of head room to be left in the bucket of FIG. 3A may be adjusted according to the needs of the particular use contemplated. It should also be noted that with the arrangement of the first rope guides (16 and 16') and the second rope guides 26 shown in FIG. 3A, the maximum amount of leverage with the minimum amount of closing rope is believed obtained. This leverage can be increased by increasing the distance at which the axis of rotation of each of the rope guides 16, 16' or 26 lies from the axis of the central load bearing shaft 10.

On FIGS. 2, 3 and 3A, equalizer and stiffening bars and guide rollers have been omitted from the drawings for greater clarity. It is within the skill of the art to provide such apparatus, which will not interfere with the construction of buckets in accordance with my invention. It is further to be noted that the length of corner arms 6 may be varied considerably depending upon the configuration of clamshell scoop halves 4 chosen by the designer. The corner arms need be only so long as to permit the bucket to open and close fully. It is believed that the configuration of rope guides shown in at least FIGS. 2, 3, and 3A displays the minimum necessary structure for a clamshell scoop arrangement.

Figure 4:
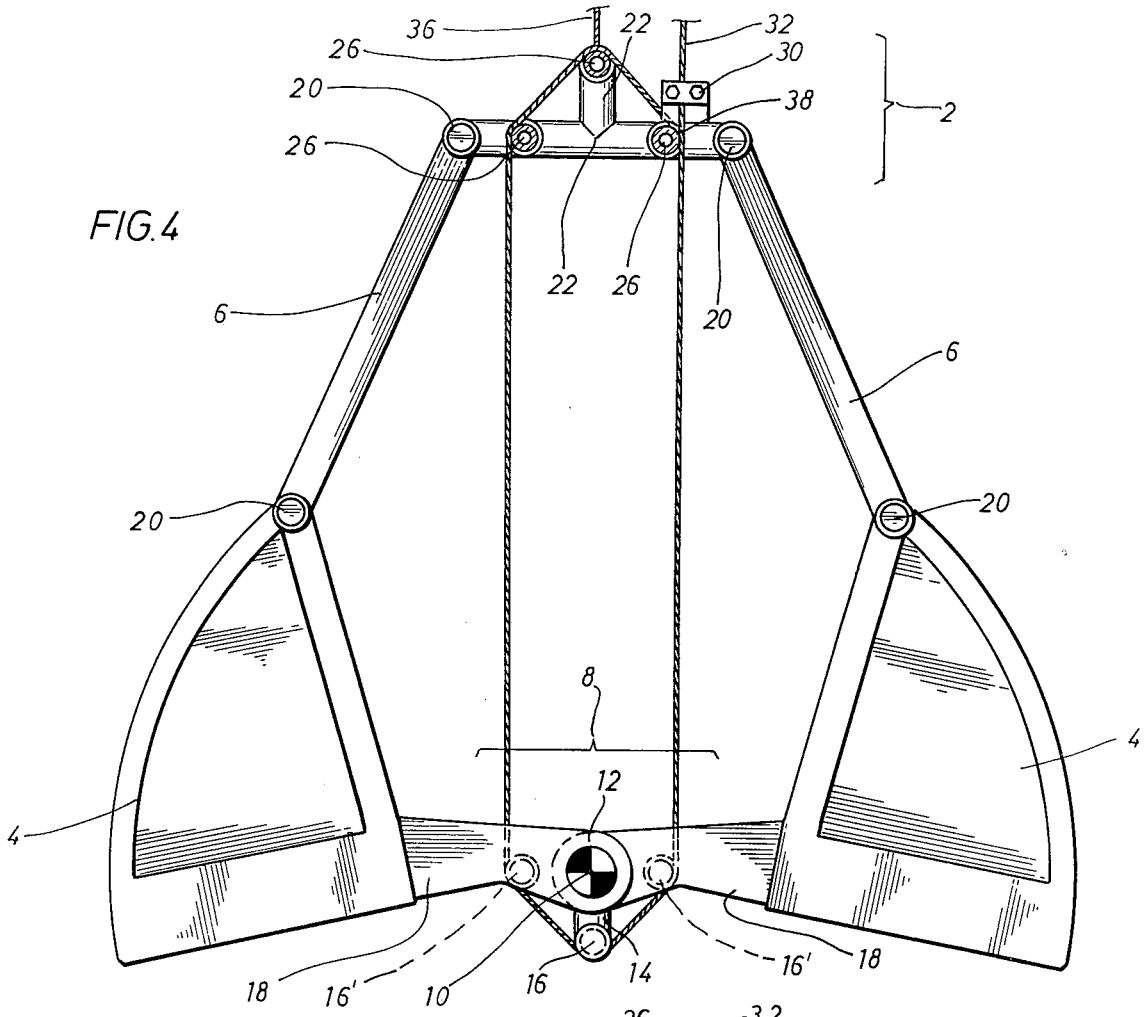
FIG. 4 is a side view of a 2-line clamshell bucket incorporating my invention, depicted in the fully open position.
Figure 4A:
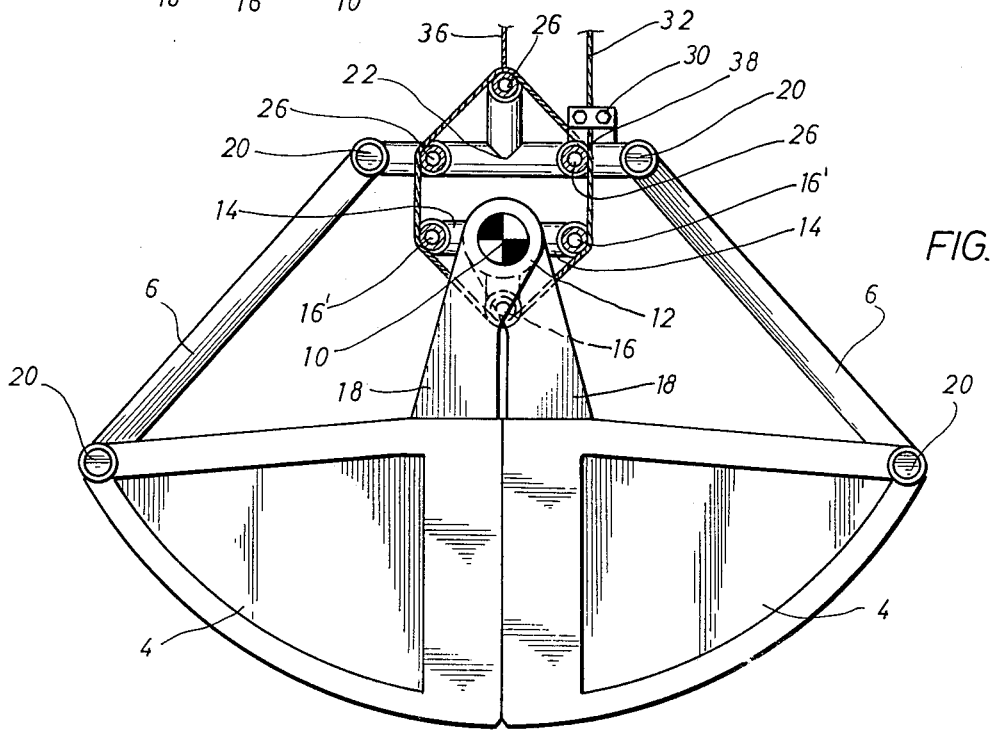
FIG. 4A depicts the bucket of FIG. 4 in the closed position.

FIGS. 4 and 4A show a 2-line bucket in accordance with my invention. The holding line 36 dead ends on the top of the head support member 22 and may be affixed to the head support member 22 by any suitable connection (not depicted). The closing line 32 is reeved about the first and second rope guides 16 and 16' and 26, respectively, so that it dead ends at point 38 on one of the second rope guide means 26, as depicted. Closing rope 32 is guided from the head assembly 2 through guide rollers 30, which may be of conventional design. As in FIGS. 2, 3 and 3A, closing rope 32 and holding rope 36 extend upward out of the buckets of FIGS. 4 and 4A to a trolley or crane boom head through which power may be applied to raise and lower the bucket and to provide closing force.

Figure 5:
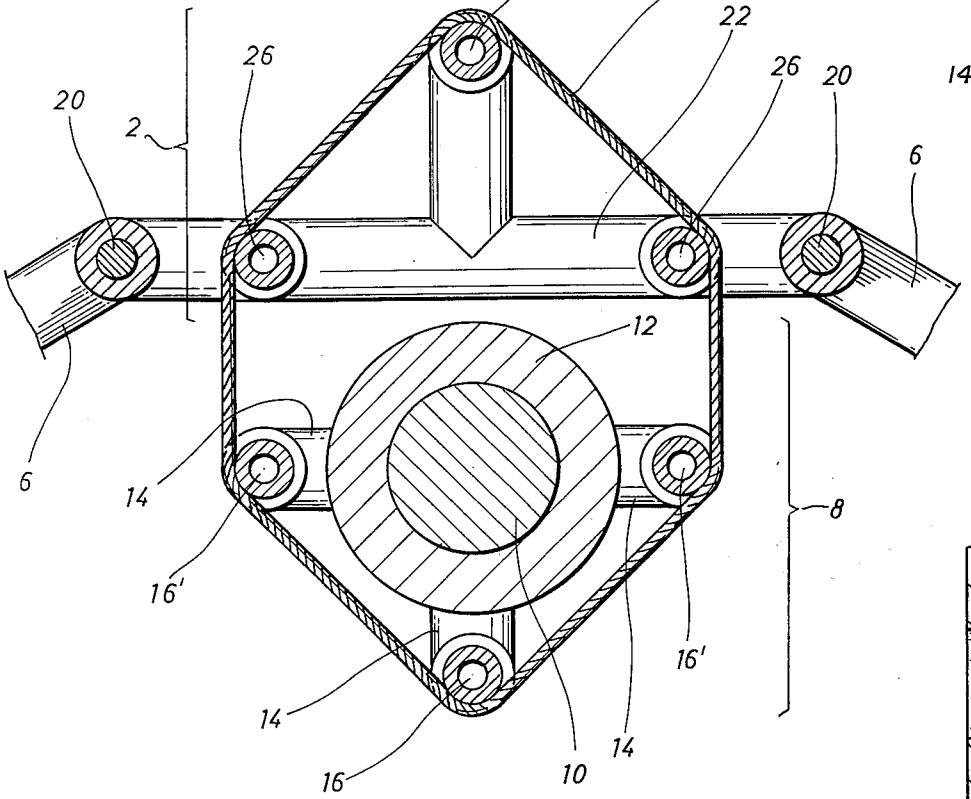
FIG. 5 is an enlarged side view of a reeved center pin and head assembly in accordance with my invention as they appear on a bucket in the closed position.

FIG. 5 is an enlarged view showing head assembly 2 and center pin assembly 8 in close juxtaposition, as when buckets as depicted in FIGS. 2, 3, 3A, 4 and 4A are in the closed position. The closing rope 32 is depicted as reeved about the head and center pin assemblies in schematic fashion, the working ends of closing rope 32 not being depicted in FIG. 5. As can be seen from FIG. 5, the amount of head room between the center pin assembly and the head assembly may be reduced or virtually eliminated by the choice of diameters for the central load bearing shaft 10 and the cylindrical collar 12.

In FIG. 5, at least one of the three rope guides 26 lies above the horizontal plane passing through the points of connection of the corner arms 6 to the head assembly 2. The other rope guides 26 may lie above that plane, if desired, but the rope guides 26 should not be disposed below that plane (except in the case discussed herein). In FIG. 5, it should be appreciated that the rope guide 26 disposed farthest above the horizontal plane bends the closing rope 32 ninety degrees. The other two rope guides (whether they are disposed with their axes on or above the plane) each bend the rope 32 forty-five degrees.

In the case of finely ground and easily handlable cargoes (as, for example, soybean meal or some fertilizers) a rope guide configuration wherein one guide 16 lies below the reference plane (as defined in FIG. 9), one rope guide 26 lies above the horizontal plane passing through the points of connection between the corner arms 6 and the head assembly 2, and two intermediate rope guides (similar in function to the guides 16') may be used. The intermediate rope guides lie between the guides 16 and 26 disposed as set forth above. Preferably (but not necessarily) the intermediate rope guides depend downwardly (below the horizontal plane) from the head. Alternately, the intermediate rope guides may be mounted to the center pin assembly, at or above the reference plane.

In FIG. 5, the minimum number of rope guides 16 and 26 is shown to be three, with the guides arranged in a semicircular configuration above and below the head and center assemblies respectively. These configurations are believed to exhibit the least weight and most compact dimensions. The addition of further rope guides (as in FIG. 7 for example) accommodates various rope flexibilities. The three rope guide configuration allows the proper moment to be applied to the scoops during the closing motion thereof. It should be recognized by those skilled in the art that the magnitude of the moment applied is dependent upon the number of complete wraps of the closing rope around the guides. This magnitude necessarily changes in accordance with the material being handled.

Figure 6:
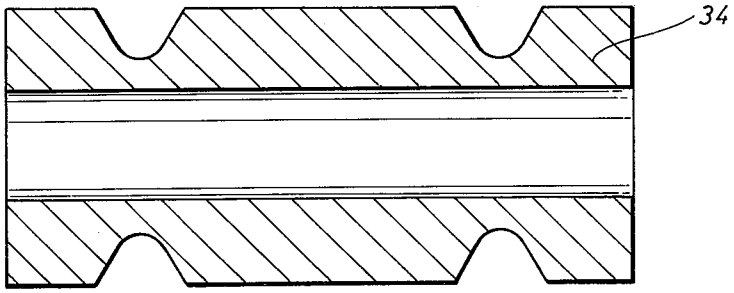
FIG. 6 is a longitudinal section of a cylindrical grooved roller in accordance with my invention.

FIG. 6 shows a longitudinal cross section of a cylindrical grooved roller 34 which possesses two annular grooves for guiding rope through the head or center pin assemblies of buckets and grapples constructed in accordance with my invention. This grooved roller 34 is preferably constructed of a very hard material having a Rockwell C hardness of at least 60, and preferably 65 or more. When these grooved rollers 34 are used in grapples and clamshell buckets in accordance with my invention, they may be sealed into the head and center pivot assemblies by means of bearings, which are not depicted, such as those used on caterpillar vehicle treads. The use of such bearings reduces or eliminates problems caused by the fouling of the rollers when the rollers come in contact, as they will, with the materials being handled by the equipment.

It is also acceptable to prevent fouling of the sheaves or rollers used on the center pivot assembly by welding or riveting a shield (not depicted) around and under these sheaves or rollers. Such an expedient is well-known in the art.

Figure 7:
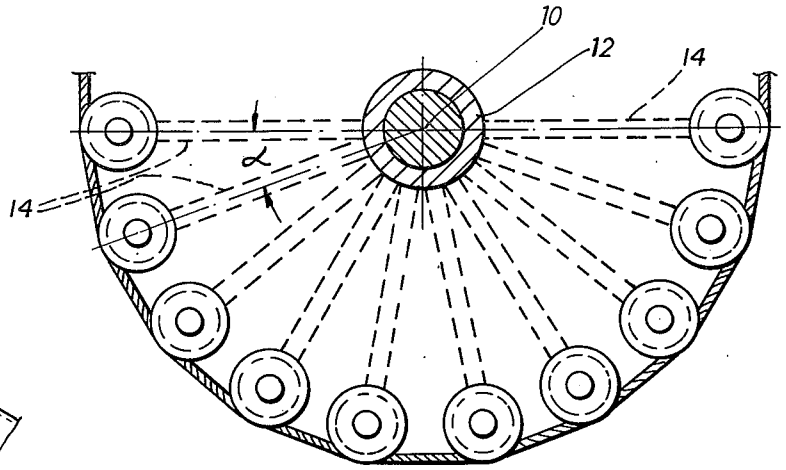
FIG. 7 is a schematic side view of the center pin assembly with ten sheaves arranged along a half circumference around the center load bearing shaft.

FIG. 7 depicts an alternate sheave or roller arrangement in accordance with my invention. The embodiment depicted in FIG. 7 shows 10 sheaves or rollers occupying half of the circumference of a circle centered upon axis of rotation of central load bearing shaft 10. Each of these sheaves or rollers is angularly spaced by angle $\alpha$, which may be calculated from the number of sheaves or rollers as being 20°. The use of ten or more sheaves is particularly preferred because it has been found that substantial advantages in rope wear are not achieved until rope bending is reduced to 20° or less per sheave, in comparison with the rope wear observed when the rope is bent as much as 180° around one sheave, as is seen in buckets and grapples according to the prior art. My invention is the only known way of providing an effective 180° bend in a wire rope without the rope wear usually observed where bends of 180° are employed.

Although not depicted, my invention is suitable for single-line buckets, which use a latching device on the bucket to hold it closed so that the bucket may be lifted once it has been closed on the material. This latch effectively replaces the holding rope 36 of FIGS. 4 and 4A.

Figure 8A:
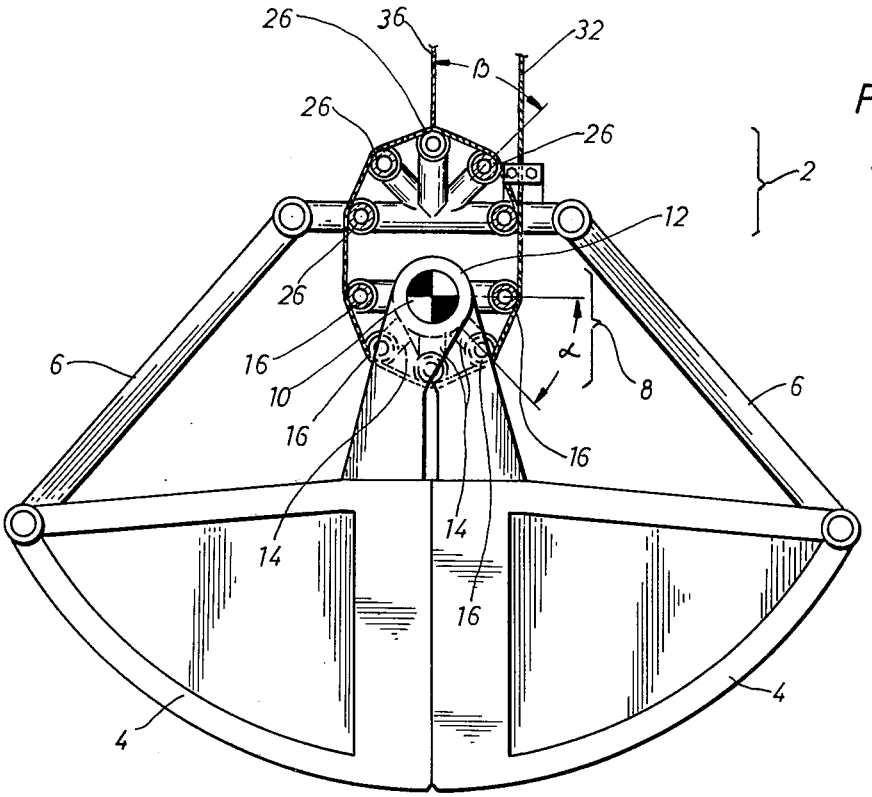
FIGS. 8A and 8B are side views of a load lifting and carrying assembly wherein at least three first and second rope guides are disposed in a semicircular configuration below and above the center pin and head assemblies and wherein the gripping members may be either clamshell scoop halves or grapple tines as respectively shown in FIG. 8A and FIG. 8B.
Figure 8B:
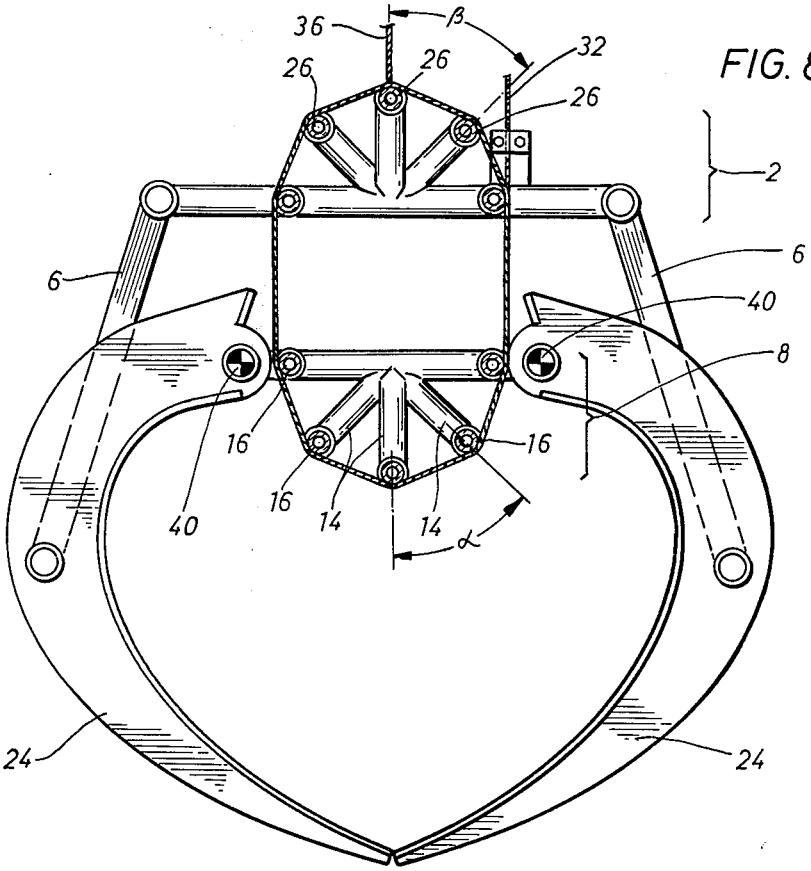

With reference now to FIG. 8, shown is an embodiment of my invention wherein a rope-actuated load lifting and carrying assembly includes a head assembly 2 having two gripping members, as clamshell scoop halves 4 as shown in FIG. 8A or grapple tines 24 as shown in FIG. 8B, each connected to the head assembly 2 as by corner arms 6. The gripping members are hinged at the inner side of each member to a center pin assembly.

The center pin assembly 8 includes a central load bearing shaft to which the hinges are connected. A cylindrical collar 12 is disposed about the load bearing shaft 10. At least three support members 14 are arranged from the collar 12 in radial relation thereto, each support member having its axis below a horizontal plane passing through the rotational axis of the load bearing shaft. It is to be noted that collar-support member arrangement is but a variation of those commonly utilized and is substantially similar to the rope guide support structure shown in FIG. 10.

A first rope guide 16 is rotatably affixed to the distal end of each support member such that the first rope guides occupy half the circumference of a circle centered on the axis of the central load bearing shaft. The first rope guides are angularly spaced apart by an angle $\alpha$, where $\alpha$ is equal to 180 degrees divided by the number of first rope guides minus one. This arrangement is recognized as one similar to that described in connection with FIG. 7.

The head assembly comprises at least three second rope guides 26 also arranged in a semicircular configuration above a horizontal plane passing through the points of connection of the corner arms to the head assembly. The semicircular configuration of the second rope guides is preferably centered on a point which defines the intersection of the plane passing through the points of connection of the corner arms to the head assembly and a line perpendicular to that plane, the line containing the center of rotation of the load bearing shaft. The second rope guides are angularly arrayed apart by an angle $\beta$, where $\beta$ equals 180 degrees divided by the number of second rope guides minus one.

As seen in FIG. 8, at least one rope is suitably reeved through the first and second rope guides to hold the load lifting and carrying assembly and to exert a closing force on the gripping members. Of course, more than one rope may be utilized.

Figure 9:
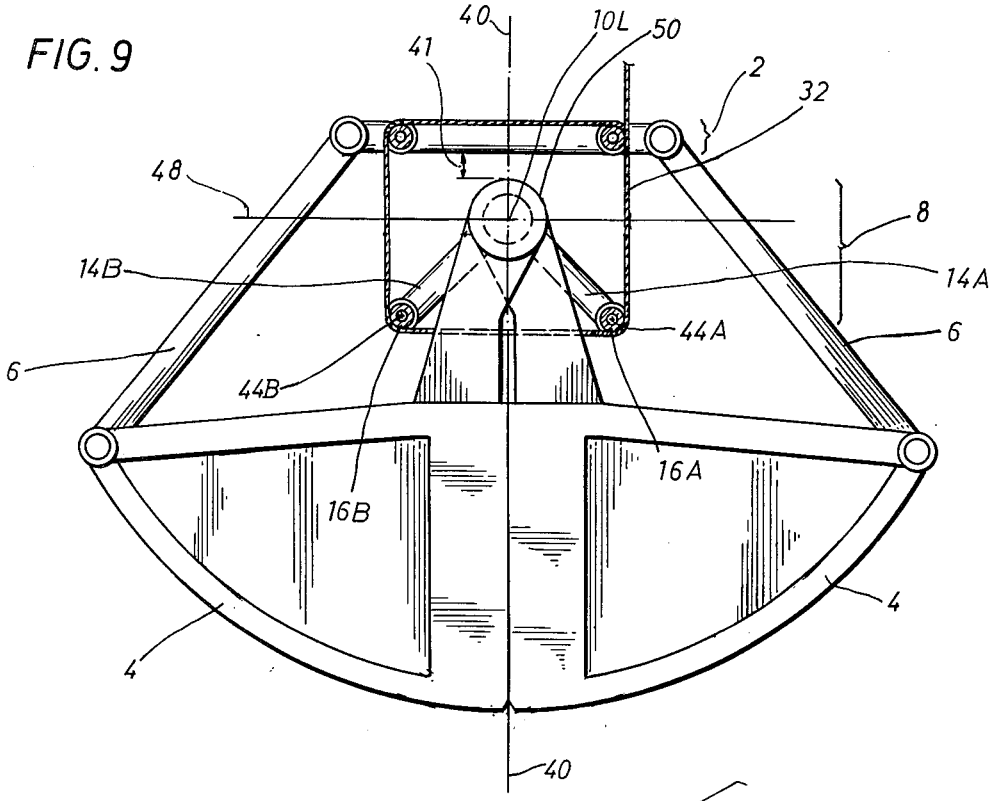
FIG. 9 is a side view of a modified clamshell arrangement in accordance with my invention wherein there is at least one rope guide, in the form of a sheave having the axis of rotation thereof disposed below a reference plane containing the axis of rotation of the center pin.

With reference now to FIG. 9, shown is an alternate embodiment of my invention in which clamshell scoops or buckets 4 are movable between an open position and a closed position (shown in FIG. 9) as a result of the exertion of a closing force applied thereto by the closing rope 32. In FIG. 9, when the buckets 4 are in the closed position, a joinder plane 40 is defined between the confronting and joined surfaces thereof. Of course, if grapples (as shown in FIG. 8B and as will be apparent to those skilled in the art) are utilized, the joinder plane 40 extends as a plane of symmetry with respect to the grapples, the plane of symmetry extending through the point of contact of the tines 24 and also through the axis of rotation of the central pin. In FIG. 9, the center pin assembly 8 is spaced a predetermined distance 41 below the head assembly 2. The distance 41 could be any desired distance including the case wherein the head 2 is disposed next-vertically above the topmost point of any structure included within the center pin assembly 8.

First rope guides indicated by reference numerals 16A and 16B are supported in a depending relationship from the center pin assembly by struts 14A and 14B. The rope guides 16A and 16B each engage the guide closing rope 32.

It is in accordance with this invention to dispose the rope guides 16A and 16B so that the axes of rotation 44A and 44B thereof at all times lie below a predetermined reference plane 48. The predetermined reference plane 48 is that plane which extends perpendicularly to the joinder plane 40 when the scoops 4 (or grapples 24) are closed. The reference plane 48 contains the axis of the rotation 10L of the center pin 10.

It is noted that the configuration of rope guides 16A and 16B shown in FIG. 9 is but an extension of the structure shown in FIGS. 3, 3A, 4, 4A, and 5 in which only one rope guide 16 is disposed such that its axis of rotation lies at all times below the reference plane defined as set forth above. It should be noted from all these Figures that the rope guide 16 disposed farthest below the reference plane 48 (as defined in FIG. 9) bends the closing rope 32 ninety degrees, while the other rope guides 16' (which may be on the reference plane or below, if desired) each bends the closing rope 32 forty-five degrees.

It should also be noted that it is only necessary for the axes of rotation 44A and 44B of the rope guides 16A and 16B, respectively, to lie below the predetermined reference plane 48. Thus, it lies within the contemplation of this invention to have a portion of the structure of the guides themselves lie on or above the reference plane 48 so long as the axes of rotation 44 lie therebelow.

It should also be noted that if a clamshell scoop or a grapple arrangement is utilized which contains more than one center pin, the reference plane 48 would be the plane that extends perpendicular to the plane of joinder 40 and that contains the effective axis of the dual center pin assembly. Of course, if any other configuration of center pins is utilized, the effective axis thereof lies within the reference plane 48 in accordance with this invention.

It is known in the art to utilize "scissors-type" buckets in which the hinge arms 18 intersect and receive the center pin 10 at a point intermediate their length. With this type of bucket configuration, the guide rollers or sheaves therefor are disposed at the ends of the hinge arms opposite the bucket. When the jaws or buckets are in the open position, it is possible that the guide rollers or sheaves lie below the reference plane as defined above. However, when the buckets of the scissors arrangement are moved toward the closed position, the rope guides therefor displace to a position above the reference plane. Thus, it is clear that these rope guides do not, at all times, lie below the predetermined reference plane.

Figure 10:
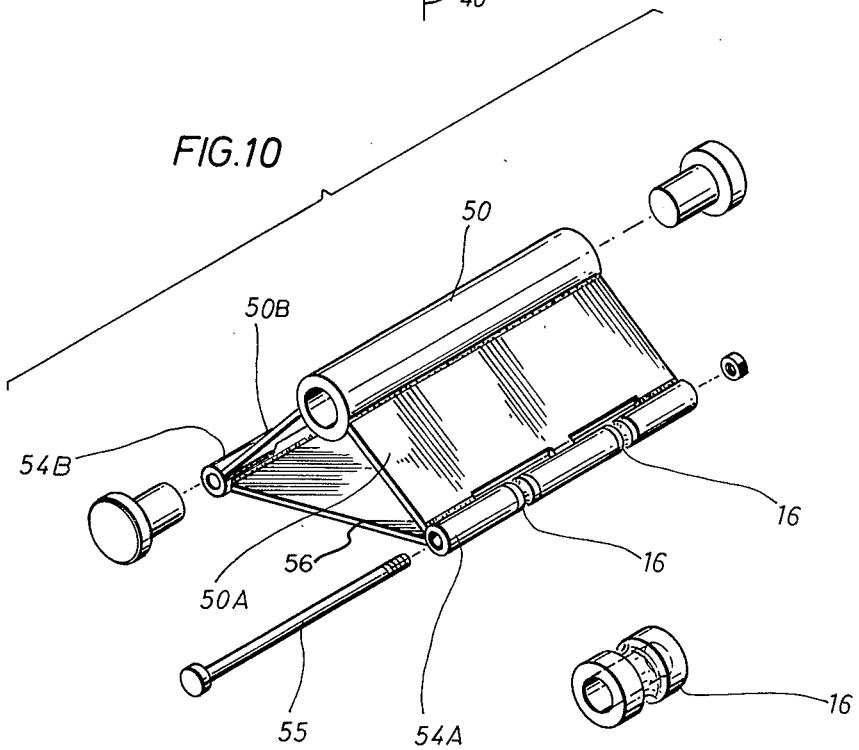
FIG. 10 is a perspective view of a rope guide mounting structure on which rope guides in the form of sheaves are disposed in accordance with the instant invention.

With reference now to FIG. 10, shown is an isolated perspective view of a rope guide support arrangement which lies within the contemplation of this invention. It is known in the art to utilize such rope guide support structures which have a center pin receiving member 50 (typically in the form of a tubular collar 10 similar to that shown in FIG. 2). Depending from the center pin support member 50, as by plates 50A and 50B are rope guide support members 54A and 54B, respectively. The rope guide support members support rope guides 16 shown in the form of cylindrical rollers mounted on threaded axles 55 (although any other suitable rope guides, as sheaves, may be used). These guide rope support members may themselves be braced as by a strut or plate 56.

The wide-span bucket, discussed above, has the rope guide below the axis of the center pin, but does not have a head structure above and separated from the center pin so that there is no distance the closing rope must travel, hence the moment derived from the force in that rope travelling through that distance is not obtained.

It is a known practice in the art to utilize center pins known as "stub shafts" which are received at each end of the member 50. In accordance with my invention, then, the rope guides 16A and 16B would be suitably mounted to the members 54A and 54B, respectively.

It should also be noted that in those instances where the clamshell scoops (or grapples) open in directions perpendicular to the axis of the boom (not shown) from which they are supported, the axes of rotation of the rope guides 16A and 16B would be parallel to either the center pin axis 10L or to the axis of the center pin receiving member 50. However, in those instances where the scoops or grapples open and close in a direction parallel to the boom on which they are mounted, it is necessary to orient the axes of the rope guides 16 ninety degrees from their positions as shown in FIG. 10.

The foregoing description of my invention has been directed to particular embodiments in accordance with the requirements of the Patent Act and for purposes of explanation and illustration. It will be apparent, however, to those skilled in this art that many modifications and changes in the disclosed apparatus may be made without departing from the scope and spirit of my invention. Modifications in the devices disclosed necessary to satisfy the needs of any particular field installation, whether in scaling the devices up or down in size, or in providing special assessories, or in constructing the apparatus with materials chosen for environmental stability or special strength, are well within the state of the art. These, and other, modifications of the devices I have disclosed will be apparent to those skilled in this art. It is my intention in the following claims to cover all such equivalent modifications and variations as fall within the true scope and spirit of my invention.

What is claimed is:

1. A rope-actuated load lifting and carrying assembly, comprising:

(a) a support structure;

(b) at least two gripping members for carrying a load;

(c) a corner arm pivotally connecting each said gripping member to said support structure; and (d) a vertically moveable center pin assembly below the support structure, this assembly including a center pin about which each of the gripping members is pivotally connected such that the gripping members can close to take on a load and such that the gripping members can open by pivotal movement around the center pin to discharge a load;

said center pin assembly further comprising at least one first rope guide rotationally mounted below the pivotal axis of the center pin, such that a rope may be reeved over this first rope guide for applying a vertical upward force to the center pin assembly to cause the center pin assembly to move vertically with respect to the support structure to thereby cause the pivotal closing movement of the gripping members, this first rope guide being at all times located beneath the center pin during the opening and closing motions of the gripping members;

the support structure also further comprising a plurality of second rope guides disposed such that the axis of at least one of the second rope guides lies above a horizontal plane through the points of connection of said corner arms to the support structure, with the axis of none of the rope guides associated with said support structure lying below said horizontal plane; and a separate support member for supporting said first rope guide and said plurality of second rope guides.

2. The load lifting and carrying assembly of claim 1, wherein said gripping members are grapple tines.

3. The load lifting and carrying assembly of claim 1, wherein said gripping members are two clamshell scoop halves.

4. The load lifting and carrying assembly of claim 1, wherein said first and second rope guides are cylindrical sheaves.

5. The load lifting and carrying assembly of claim 1, wherein said first and second rope guides are grooved rollers.

6. The load lifting and carrying assembly of claim 5, wherein said grooved rollers are composed of a substance having a Rockwell C hardness of at least 60 and wherein the rope employed is wire rope.

7. The assembly as defined in claim 1, characterized by the center pin assembly further including at least two more rope guides, these two additional rope guides being located on opposed, horizontal diametric sides of the center pin such that a rope may be reeved over each of these two additional rope guides to be turned for purposes of being reeved over the first rope guide beneath the center pin.

8. The assembly as defined in claim 1, characterized by the center pin assembly including a pair of first rope guides mounted below the center pin, these rope guides being positioned such that a radial line through the center pin and each rope guide forms an angle of about 45° with a horizontal plane through the center pin.

9. The assembly as defined in claim 1, wherein said first rope guide includes at least a pair of spaced, annular grooves for guiding rope.

10. A rope-actuated load lifting and carrying assembly of the type having (a) a head assembly, (b) at least two gripping members pivotally interconnected with the head assembly and being moveable between an open position and a gripping position, the members when in the gripping position being joined along a joinder plane defined therebetween, (c) a vertically moveable actuating assembly to which each of the gripping members are pivotally interconnected, such that downward vertical movement of the actuating assembly causes the gripping members to open and such that upward vertical movement of the actuating assembly causes the gripping members to close, (d) the actuating assembly also including at least a pair of rotationally mounted rope guides for guiding rope, these rope guides being mounted and arranged so that a rope will be reeved thereover such that the rope can be turned 180° and such that the rope can exert an upward vertical force on the rope guides to cause upward vertical movement of the actuating assembly to close the gripping members, these rope guides being employed in lieu of a single larger sheave in order to achieve the same closing force but reducing the overall weight in the assembly, and each of the rope guides including at least a pair of spaced, annular grooves for receiving and guiding rope.

11. The assembly as defined in claim 10, characterized by the actuating assembly including a center pin about which the gripping members are pivotally mounted, the rope guides being arrayed such that at least one guide is mounted below the pivotal axis of the center pin such that this guide is at all times located beneath the center pin during the opening and closing motions of the gripping members.

12. The assembly as defined in claim 11, characterized by the actuating assembly including a pair of rope guides mounted below the center pin.

13. The assembly as defined in claim 11, characterized by the actuating assembly including at least three rope guides, at least two of the rope guides being mounted on opposed, horizontal, diametric sides of the center pin.

14. The assembly as defined in claim 10, further including a separate support member supporting each of said rope guides.

15. A rope-actuated load lifting and carrying assembly, comprising:

(a) a head assembly;

(b) at least two gripping members;

(c) a corner arm connecting the outer side of each said gripping member to said head assembly;

(d) a center pin assembly;

(e) a hinge connecting the inner side of each said gripping member to said center pin assembly;

wherein said center pin assembly further comprises a central load bearing shaft to which said hinges are connected, at least three support members radially arranged about said central load bearing shaft and a rope guide rotationally mounted on each of said support members to form a first group of rope guides, the rotational axis of each of the rope guides being essentially parallel to the axis of the central load bearing shaft and at least one of the guides being arranged such that its axis is positioned below a horizontal plane passing through the axis of the central load bearing shaft, and said rope guides occupying half the circumference of a circle centered on the axis of said central load bearing shaft and are angularly spaced apart by angle $\alpha$, where $\alpha$ equals 180 degrees divided by the number of said first rope guides minus one, each rope guide having at least a pair of spaced grooves for receiving and guiding rope, and wherein said head assembly comprises at least one additional rope guide located above a horizontal plane passing through the points of connection of said corner arms to said head assembly.

16. The load lifting and carrying assembly of claim 15, wherein said head assembly comprises at least three rope guides, constituting a second group of rope guides, which lie on half of the circumference of a circle and are angularly arrayed apart by an angle $\beta$, where $\beta$ equals 180 degrees divided by the number of said second group of rope guides minus one, and at least one of the rope guides associated with the head assembly being located above a horizontal plane passing through the points of connection of said corner arms to said head assembly.

17. The load lifting and carrying assembly of claim 15, wherein said gripping members are two clamshell scoop halves.

18. The load lifting and carrying assembly of claim 16, wherein the gripping members are two clamshell scoop halves.

19. The load lifting and carrying assembly of claim 16, wherein said gripping members are grapple tines.

20. The load lifting and carrying assembly of claim 16, wherein said first and second rope guides are cylindrical sheaves.

21. The load lifting and carrying assembly of claim 20, wherein said center pin assembly carries thereon at least ten sheaves.

22. The load lifting and carrying assembly of claim 16, wherein said first and second rope guides are grooved rollers.

23. The load lifting and carrying assembly of claim 22, wherein said center pin assembly carries thereon at least ten rollers.

24. The load lifting and carrying assembly of claim 16 or 17, and further comprising at least another additional rope guide on said head assembly over which is reeved a second rope to hold said load lifting and carrying assembly.

25. The load lifting and carrying assembly of claim 24, wherein said first group of rope guides and said additional rope guide are rollers and wherein said another additional rope guide is provided by a groove on a roller that also acts as one said additional rope guide.

26. The load lifting and carrying assembly of claim 25, wherein said grooved rollers are composed of a substance having a Rockwell C hardness of at least 60 and wherein the rope employed is wire rope.

27. The load lifting and carrying assembly of claim 15, wherein said gripping members are grapple tines.

28. The load lifting and carrying assembly of claim 15, wherein said first and second rope guides are cylindrical sheaves.

29. The load lifting and carrying assembly of claim 28, wherein said center pin assembly carries thereon at least ten sheaves.

30. The load lifting and carrying assembly of claim 15, wherein said first and second rope guides are grooved rollers.

31. The load lifting and carrying assembly of claim 30, wherein said center pin assembly carries thereon at least ten rollers.

* * * * *